US005675935A

United States Patent [19]

Lin

[11] Patent Number: 5,675,935

[45] Date of Patent: Oct. 14, 1997

[54] DOOR SEALING MECHANISM

[76] Inventor: Chen-Yi Lin, 2nd Fl., No. 11, Lane 16, Nan Kang Rd., Sec. 3, Taipei, Taiwan

[21] Appl. No.: 498,123

[22] Filed: Jul. 5, 1995

[51] Int. Cl.[6] ..... E06B 7/20

[52] U.S. Cl. ..... 49/306; 49/470

[58] Field of Search ..... 49/303, 306, 307, 49/470

[56] References Cited

U.S. PATENT DOCUMENTS

| | | | |
|---|---|---|---|
| 872,642 | 12/1907 | Bujewski | 49/307 |
| 1,986,701 | 1/1935 | Zimmermann | 49/470 X |
| 3,072,977 | 1/1963 | Burda | 49/307 |
| 3,703,788 | 11/1972 | Rivers | 49/307 |
| 4,479,330 | 10/1984 | Müller | 49/303 |
| 4,519,165 | 5/1985 | Cronenberg et al. | 49/307 |
| 5,454,192 | 10/1995 | Adler et al. | 49/307 |

*Primary Examiner*—Blair Johnson
*Assistant Examiner*—Jerry Redman
*Attorney, Agent, or Firm*—Shoemaker And Mattare, LTD

[57] ABSTRACT

Disclosed is a door sealing mechanism for sealing specifically the horizontal gaps between bottom rail and sill and between top rail and lintel. The door sealing mechanism comprises a sealing member including a flexible, elongated blocking portion having a length greater than the height of the horizontal gap. A retractable mounting piece is used to mount the sealing member thereon and which is retractable when the sealing member is subject to an external force. An elastic member as a spring is coupled to the retractable mounting piece, which exerts a force on the sealing member when the retractable mounting piece is in retracted position and also allows the retractable mounting piece to restore to original position after the external force on the sealing member is removed. When dosing the door, the blocking portion is bent and the retractable mounting piece is retracted; and when the door is in closed position, the combination of the bending of the flexible blocking portion and the force exerted by the elastic member together allows the blocking portion to be in forced contact with the sill or the lintel. The door-sealing mechanism will not hinder the movement of the door and which can seal horizontal gaps of various heights without further adaptations and nonetheless provide air-tight sealing effect to the door.

8 Claims, 7 Drawing Sheets

DOOR SEALING MECHANISM

BACKGROUND OF THE INVENTION

1. Field of the Invention

The present invention relates to door sealing mechanisms, and more particularly, to a door sealing mechanism specifically used to seal horizontal gaps (namely, the gap between the top rail and the lintel and the gap between the bottom rail and the sill) through the closed door.

2. Description of Prior Art

Doors are usually provided at the entrance to a building or between two rooms. When a door is closed, there are usually left four gaps through the door: two vertical gaps between the lock-side stile and doorjamb and between the hinge-side stile and doorjamb, a horizontal gap between the top rail and the lintel, and another horizontal gap between the bottom rail and the sill. In a two-door entrance, a vertical gap is formed between the two side stiles on the two doors. The existence of these gaps would allow the leakage of the inside conditioned air to the outside or the entrance of the outside dust, smoke, and insects into the room. In the event of a fire, the fumes from the fire could enter the room through these gaps.

To seal the door, a patent application also entitled "A Door Sealing Mechanism" has been filed by the applicant. The previous disclosure, however, only teaches ways to seal the vertical gaps between stiles and doorjambs and no ways to seal the horizontal gaps between bottom rail and sill and between top rail and lintel.

To solve the aforementioned problem, a conventional and simple way is to attach a soft, thin rubber tape to the bottom rail as a sealing member. This method provides acceptable dust blocking effect but the drawback is that it can only be used on the bottom rail and not on the top rail. Besides, it can be used on doors with conventional butt hinges and can not be used on doors with automatic ground hinges.

As to doors that can be turned either inwards or outwards, since they are provided with automatic ground hinges, the aforementioned conventional method can not be used. The reason can be seen from the illustration in FIG. I. Since ground hinge S1 is provided on one side of the sill C, a hinge support $2 is correspondingly provided on the bottom rail. Therefore, whether the sealing member is provided on the inside face or on the outside face of door, it will hinder the movement of the door. Presently, there exists no solution of sealing the ground-hinged doors.

On butt-hinged doors, since installations of the doors are not usually consistent, there are variations in the heights of the horizontal gaps between the bottom rail and the sill. To attach the aforementioned conventional method, the sealing member must be trimmed for each door, which is labor and time-consuming in the door installation.

SUMMARY OF THE INVENTION

It is therefore a primary objective of the present invention to provide a door sealing mechanism which can seal the horizontal gaps through the door, specifically speaking the gap between the top rail and the lintel and the gap between the bottom rail and the sill.

It is another objective of the present invention to provide a door sealing mechanism whose mounting on the bottom rail of the door will not hinder the movement of the door.

It is still another objective of the present invention to provide a door sealing mechanism which can seal horizontal gaps of various heights without further adaptation.

In accordance with the foregoing and other objectives of the present invention, there is provided a novel door sealing mechanism for sealing the horizontal gaps between bottom rail and sill and between top rail and lintel. The sealing mechanism comprises a sealing member including a flexible, elongated blocking portion having a length greater than the height of the horizontal gap. A retractable mounting piece is used to mount the sealing member thereon and which is retractable when the sealing member is subject to an external force. An elastic member as a spring is coupled to the retractable mounting piece, which spring exerts a force on the sealing member when the retractable mounting piece is in its retracted position and also allowing the retractable mounting piece to restore to its original position after the external force on the sealing member is removed. When closing the door, the blocking portion is bent and the retractable mounting piece is retracted; and when the door is in closed position, the combination of the bending of the flexible blocking portion and the force exerted by the elastic member together allows the blocking portion to be in forced contact with the sill or the lintel.

With the foregoing door-sealing mechanism, the following four benefits are provided. First, the door-sealing mechanism according to the present invention can be used on any types of doors that can be turned both inwards and outwards or only in one direction, regardless of whether the door is ground-hinged or butt-hinged. The action of the door-sealing mechanism will not be blocked and restricted by ground hinges. Second, since the sealing member used in the door-sealing mechanism according to the present invention is retractable, the movement of the door during opening or closing is very smooth, which allows the life of use of the door-sealing mechanism to be prolonged. Third, the position of the sealing member can be adjusted so as to be adapted for use in sealing gaps of various heights. Fourth, in combination with the previous patent application by the applicant, the gaps at the four sides of the door can be completely sealed to provided a total solution.

BRIEF DESCRIPTION OF DRAWINGS

The present invention can be more fully understood by reading the subsequent detailed description of the, preferred embodiments thereof with references made to the accompanying drawings, wherein:

FIG. 2–2B show a two-door unit provided with a door-sealing mechanism according to the first preferred embodiment of the present invention, wherein FIG. 2B shows the structure of the door-sealing mechanism on the bottom rail of the door taken along the line 2B—2B in FIG. 1.

DETAILED DESCRIPTION OF PREFERRED EMBODIMENT

Figure 1:
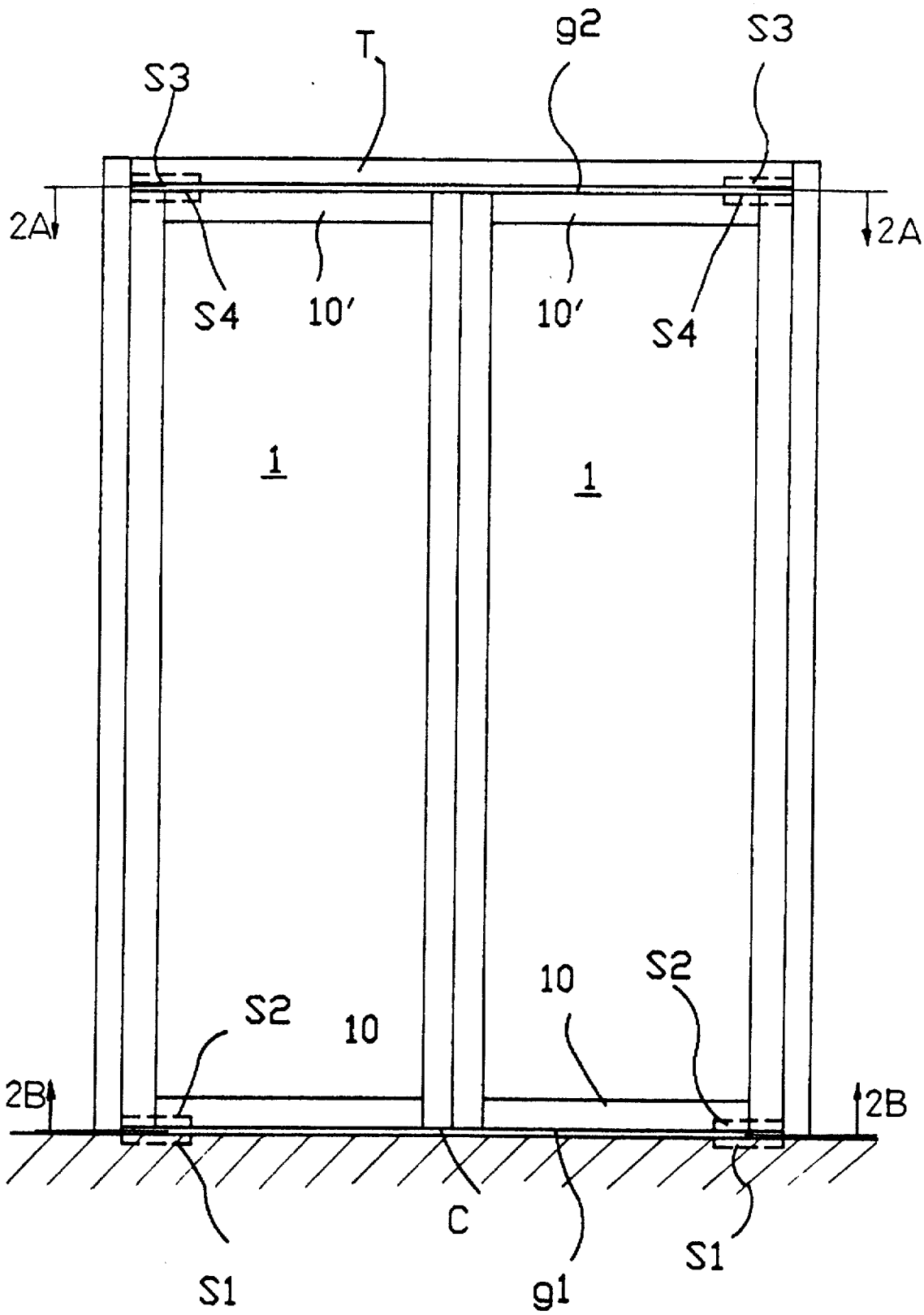
FIG. 1 shows a front view of a two-door unit.

FIG. 1 shows a two-door unit which can be pushed either inwards or outwards. The two-door unit includes two doors 1, each having a bottom rail 10 and a top rail 10'. On both sides of the sill C are there each mounted with a ground hinge S1. Correspondingly on the bottom rail 10, a hinge support S2 is coupled to the ground hinge S1. Similarly, on both sides of the lintel T are there each mounted with a hinge S3 and correspondingly on the top rail 10', a hinge support S4 is coupled to the hinge S3. By means of the pivoting through the hinges S1, S3 and the hinge supports S2, S4, the doors 1 can be opened either by turning them inwards or outwards.

First Preferred Embodiment

Figure 2A:
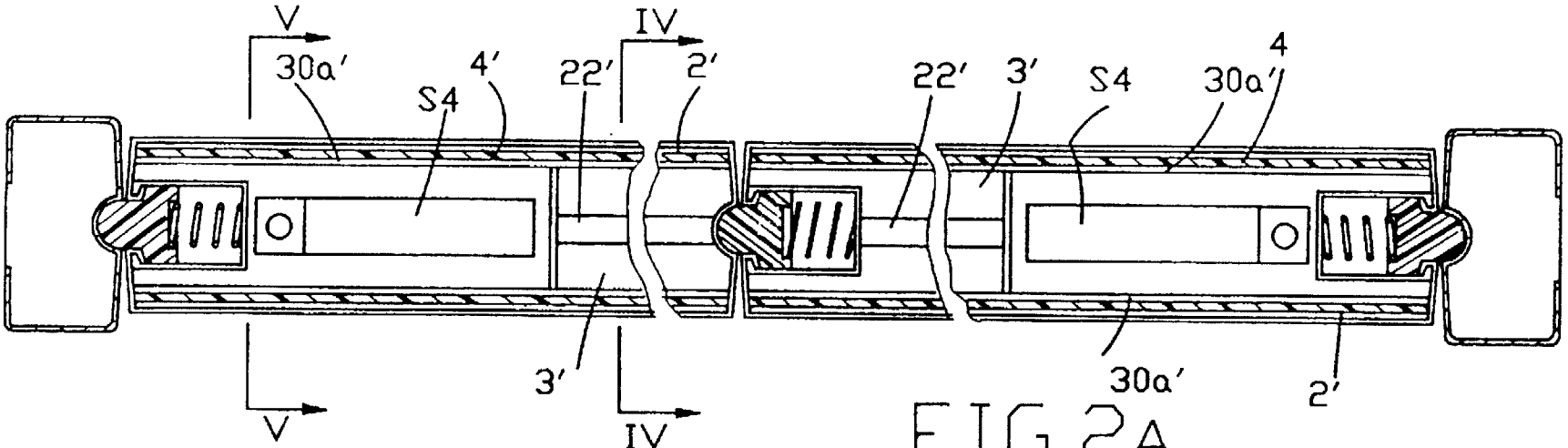
FIG. 2A shows the structure of the door-sealing mechanism on the top rail of the door taken along the line 2A—2A in FIG. 1.

The first embodiment of a door-sealing mechanism according to the present invention will be described with reference to FIGS. 2A–2B through FIG. 5. Referring to FIG. 3, the door-sealing mechanism includes two parts: a top part provided on the top rail 10' to seal the gap between the top rail 10' and the lintel T and a bottom part provided on the bottom rail 10 to seal the gap between the bottom rail 10 and the sill C. FIG. 2A shows the top part of the door-sealing mechanism viewing from the top of the door (the lintel's view) and FIG. 2B shows the bottom part of the door-sealing mechanism viewing from the bottom of the door (the sill's view).

Figure 2B:
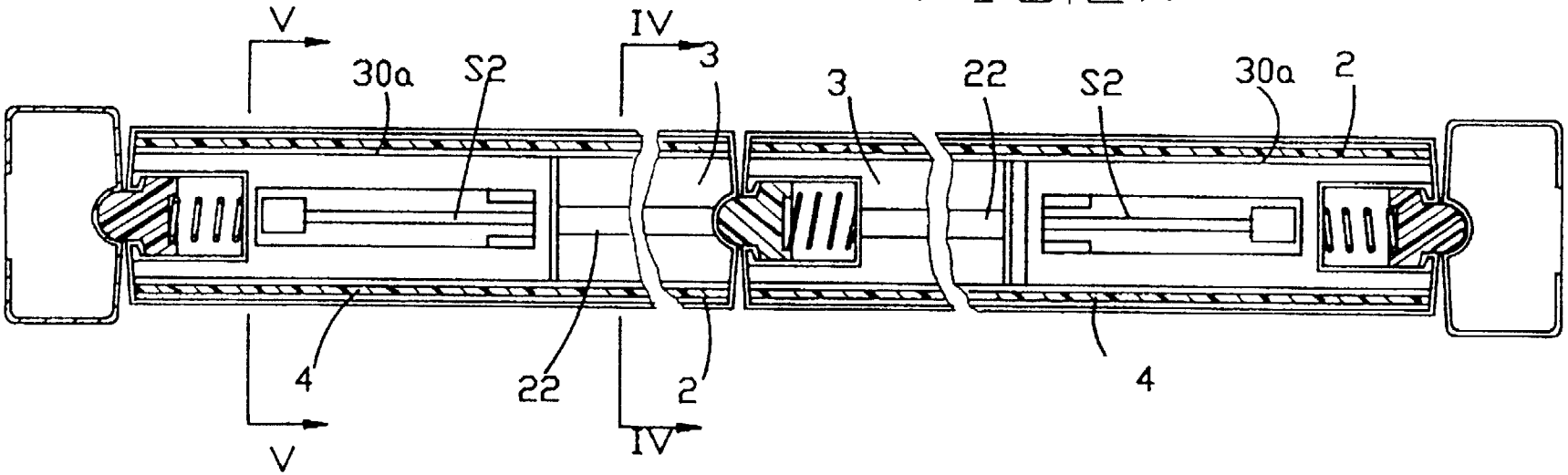
Figure 3:
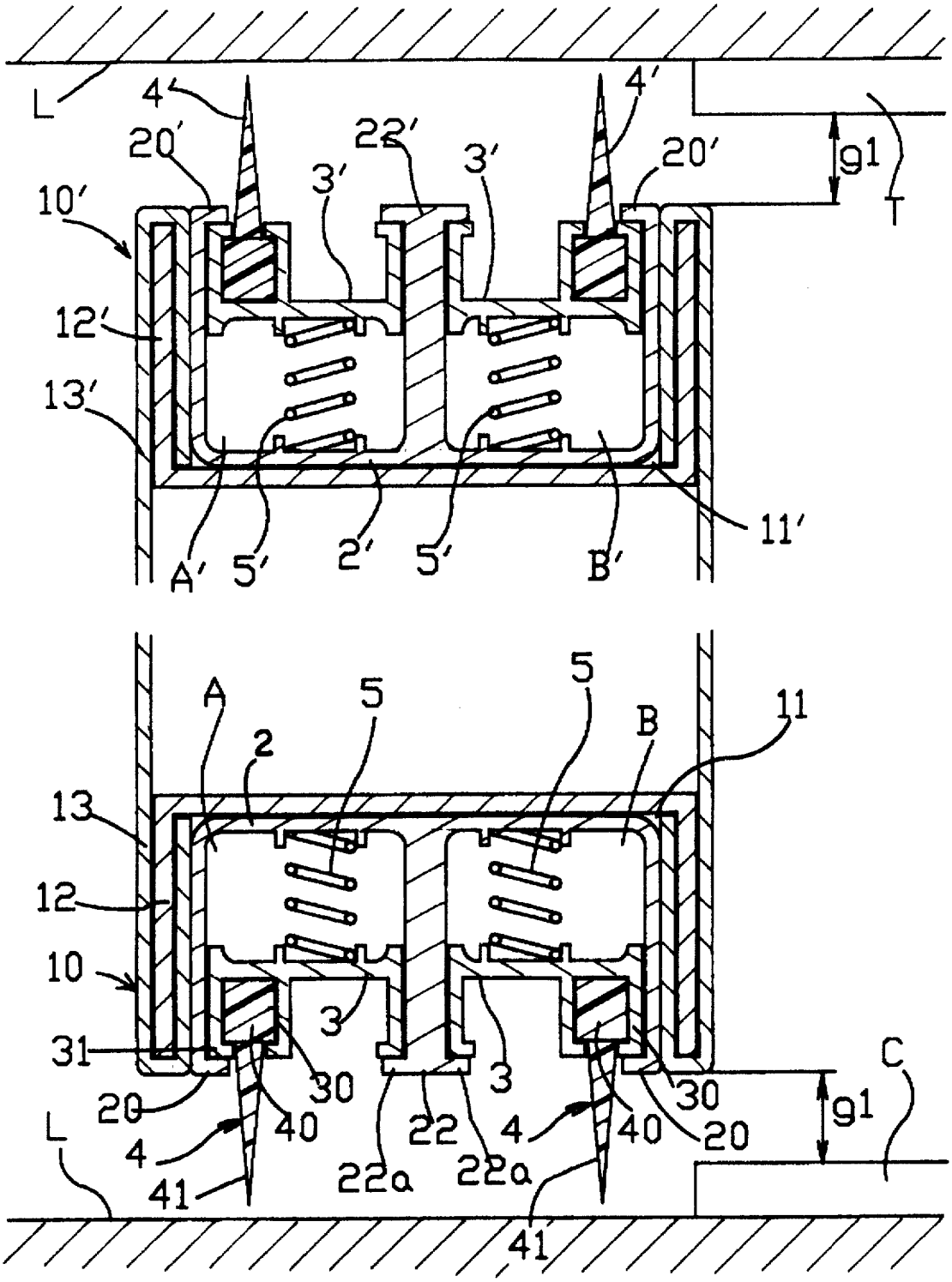
FIG. 3 is a cross-sectional view of the door-sealing mechanism according to the first preferred embodiment of the present invention when its sealing member is in uncompressed condition.

As shown in FIGS. 2A–2B and FIG. 3, the door-sealing mechanism includes a U-shaped (in cross-section) supporting base 11 inset with a frame 2. The side pieces 12 of the supporting base 11 is gripped by a bent portion 13 of the panel of the door so as to be secured to the door. The frame 2 is E-shaped in cross-section, having a center piece 22 dividing the frame 2 into two partitions A and B, each used to mount a mounting piece 3 which is U-shaped in cross section and retractably supported by a spring 5. A sealing member 4 is mounted on each of the mounting pieces 3. The free ends of the two side pieces of the E-shaped frame 2 are 90° angled so as to form first stoppers 20 and the free end of the center piece 22 is T-shaped to form a second stopper **22*a*. The first and the second stoppers 20, 22*a* together are used to prevent the mounting pieces 3 from being pushed away from the frame 2 by the springs 5**.

The sealing member 4 is composed of a base portion 40 rectangular-shaped in cross section and a blocking portion 41 triangular-shaped in cross section. The base portion 40 of the sealing member 4 is inserted into a holding structure 30 formed on the mounting pieces 3 so as to mount the sealing member 4 on the mounting pieces 3, and the blocking portion 41 is an elongated piece made of soft flexible material which can be bent when subject to external force. The length of the blocking portion 41 is provided greater than the height of the gap g1.

The spring 5 supporting the mounting pieces 3 has one end secured to the frame 2 and the other end secured to the bottom of the mounting pieces it. The provision of the spring 5 allows the sealing member 4 along with its mounting pieces 3 to be retracted into the respective partitions A, B when the sealing member 4 is subject to an external force; and when the external force is removed, they can be restored to the original position due to the elasticity of the spring 5.

As to the door-sealing mechanism provided on the top rail, the structure is completely identical to that provided on the bottom rail described above. For differentiation, the elements on the top rail are labeled with the same numerals but appended with an apostrophe mark. For simplicity of description, only the action in the door-sealing mechanism on the bottom rail 10 will be described.

Figure 4:
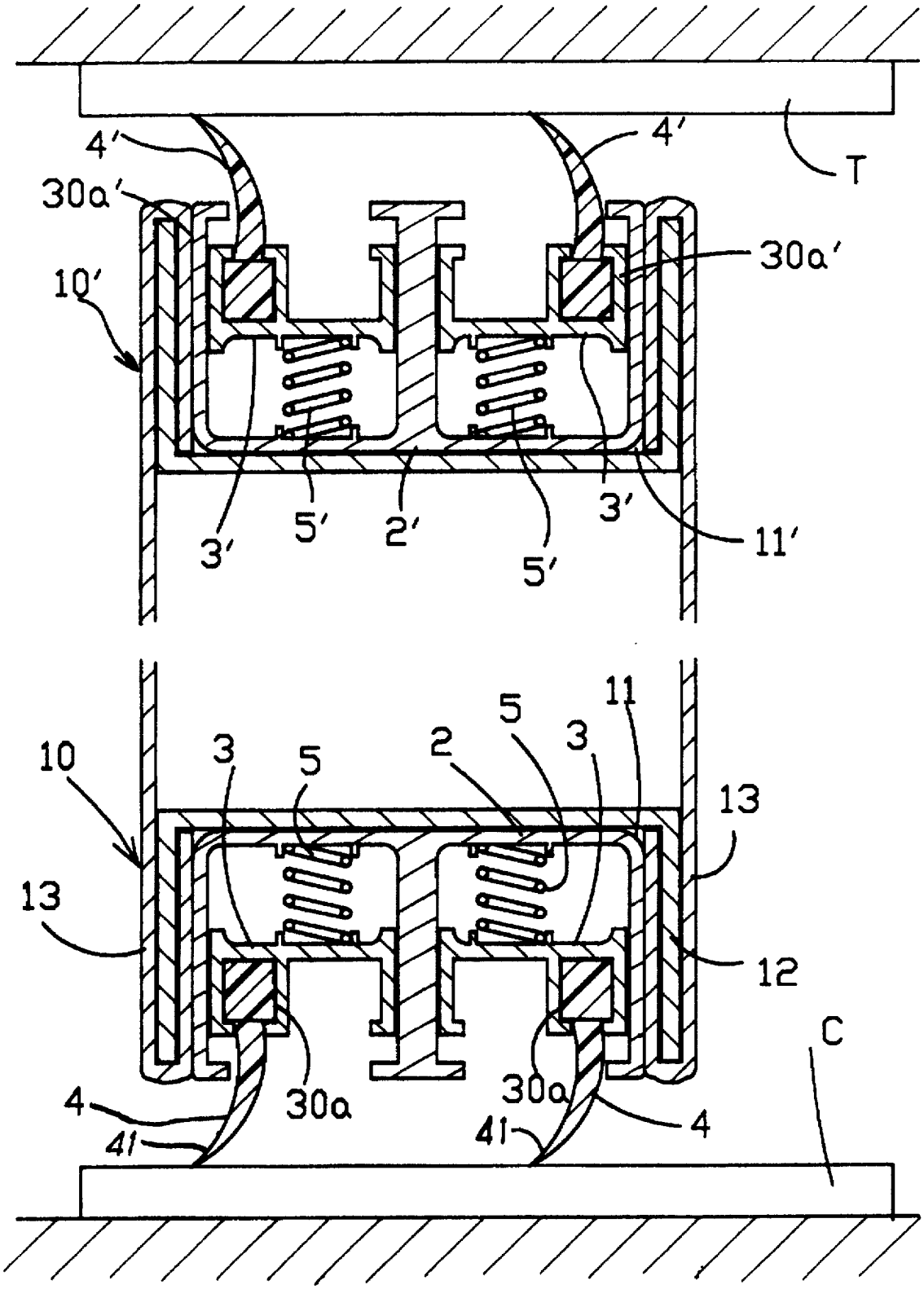
FIG. 4 is a cross-sectional view of the door-sealing mechanism of FIGS. 2A–2B cutting through the line IV—IV (when the sealing member is in compressed condition)

Referring to FIG. 4, when closing the door, the blocking portion 41 of the sealing member 4 on the bottom rail 10 comes into contact with the sill C (similarly the blocking portion 41' of the sealing member 4' on the bottom rail 10' comes into contact with the lintel T). As described above, the blocking portion 41' of the sealing member 4 is greater in its length than the height of the gap g1. However, since the blocking portion 41 of the sealing member 4 is flexible, it can be bent when coming on top of the sill C. The bending of the blocking portion 41 further exerts a force against the mounting pieces 3 and thereby pushes the mounting pieces 3 inwards. The spring 5 is thus compressed to allow the mounting pieces 3 to be retracted. When the door is in closed position, the combined force of the bending of the flexible blocking portion 41 and the elasticity of the compressed spring 5 together allows the tip of the blocking portion 41 to be in forced contact with the surface of the sill C, therefore air-tightness is firmly allowed. With the provision of two sealing members 4, air-sealing effect is doubly provided.

On the other hand, when opening the door, the blocking portion 41 of the sealing member 4 is brought to move away from the sill C. Upon leaving the sill C, the bent blocking portion 41 will restore its original shape due to its flexible property and the mounting pieces 5 will restore to its original position due to the elasticity of the compressed spring 5, as illustrated in FIG. 3. The stoppers 31 and **22*a* on the frame 3 together can prevent the mounting pieces 3 from being flipped away by the spring 5**.

Figure 5:
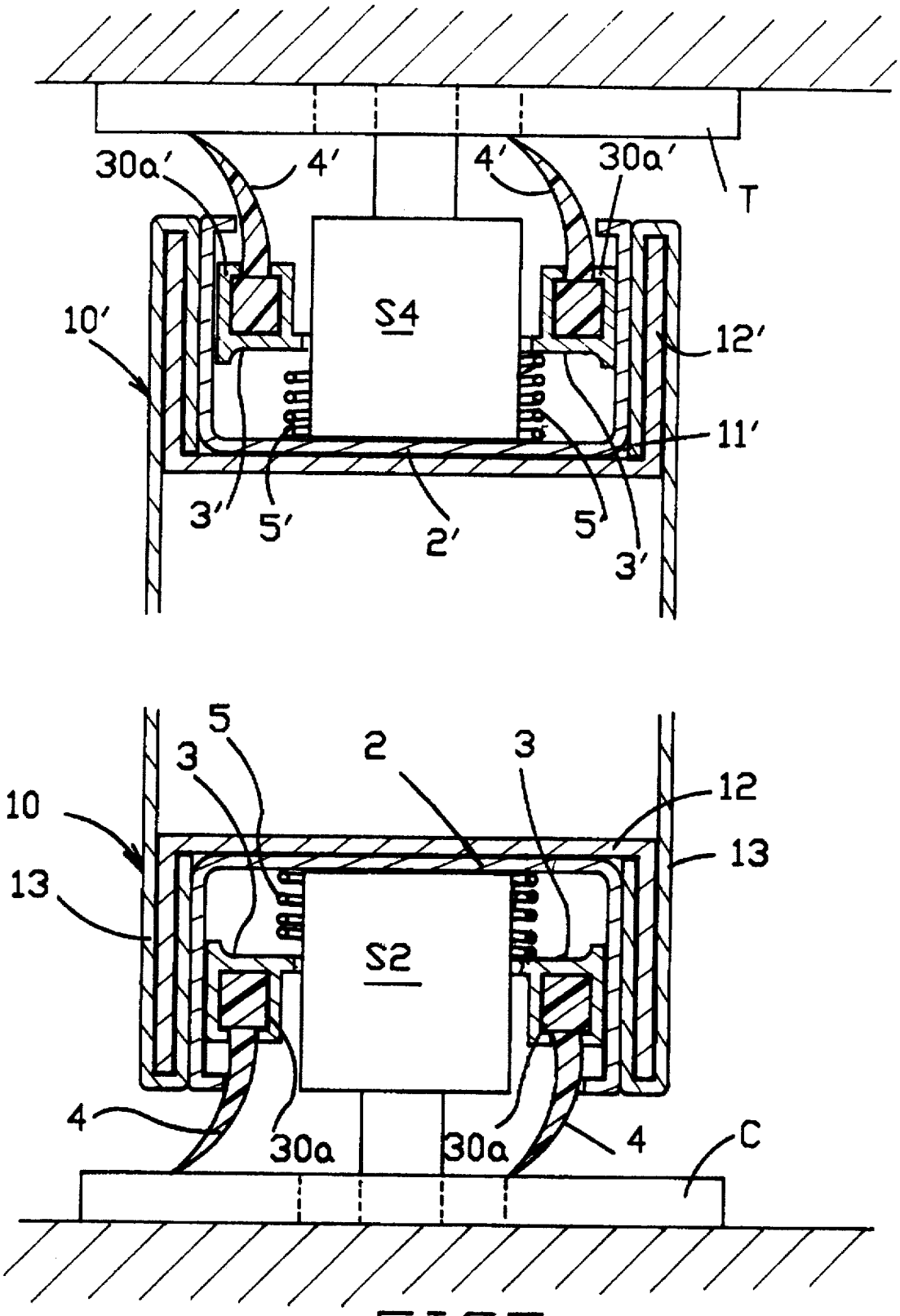
FIG. 5 is a cross-section a view of the door-sealing mechanism of FIGS. 2A–2B cutting through the line V—V (when the sealing member is in compressed condition)

FIG. 5 shows another cross section of the door-sealing mechanism cutting through the line V—V so as to show the hinge supports S2 and S4. On the bottom 10, the mounting pieces 3 each has its holding structure 30 stretched out to form an extended portion **30*a***. It can be seen from the illustration that the mounting of the door-sealing mechanism is adapted to the hinge supports S2 and S4 and so that the provision of the door-sealing mechanism will not hinder the movement of the door when closing or opening the door.

Second Preferred Embodiment

Figure 6:
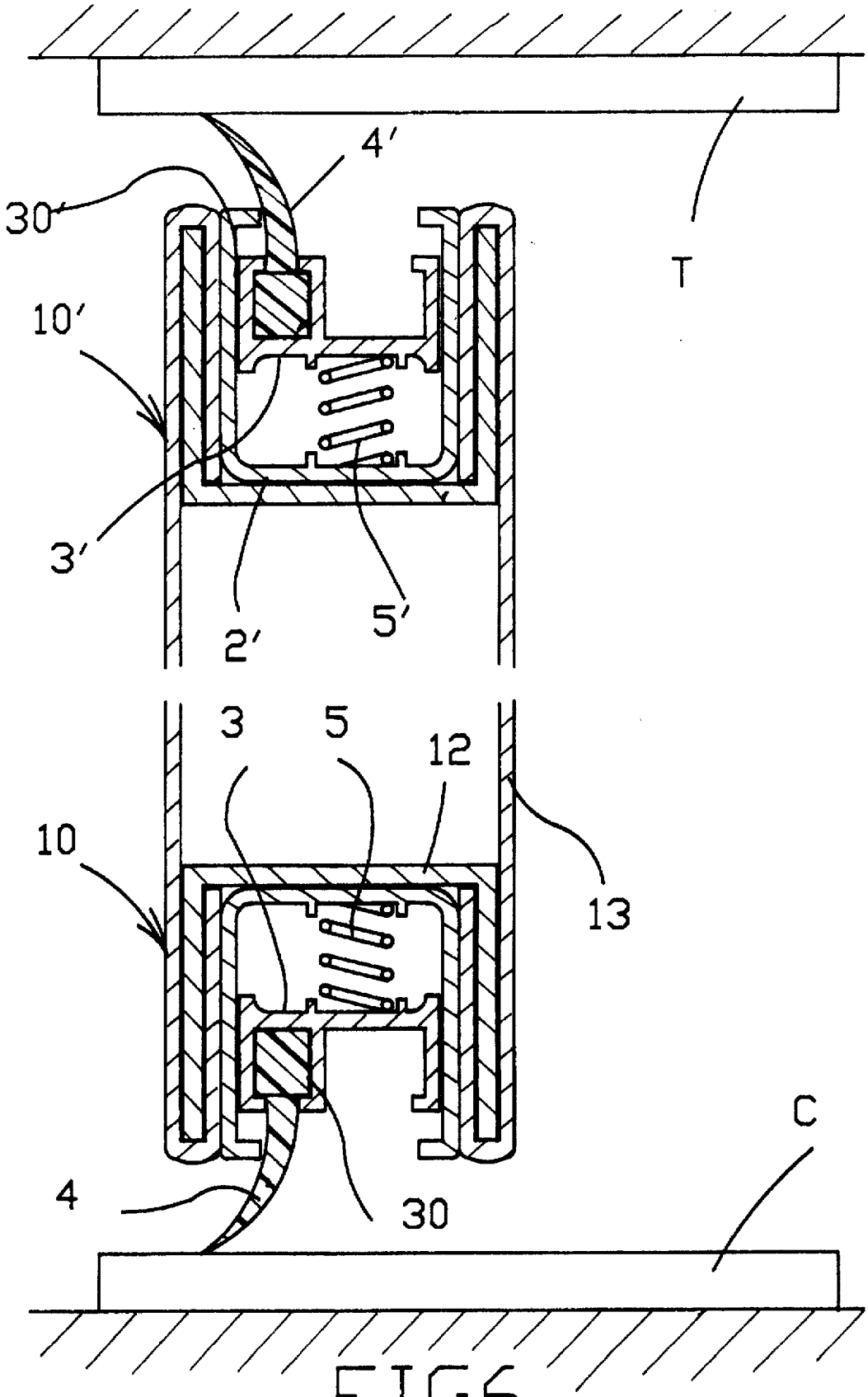
FIG. 6 is cross-sectional view of a sealing mechanism according to the second preferred embodiment of the present invention.

FIG. 6 shows the second preferred embodiment of a door-sealing mechanism according to the present invention, which is used particularly on a door having a small thickness. In this embodiment, only one sealing member 4 is provided and the constituent elements are all the same in function as those of the first preferred embodiment except that the frame 2 is slightly adapted in shape according to the varied application condition, but the modification is only for practical purpose and non-substantial to the spirit of the present invention.

Third Preferred Embodiment

Figure 7:
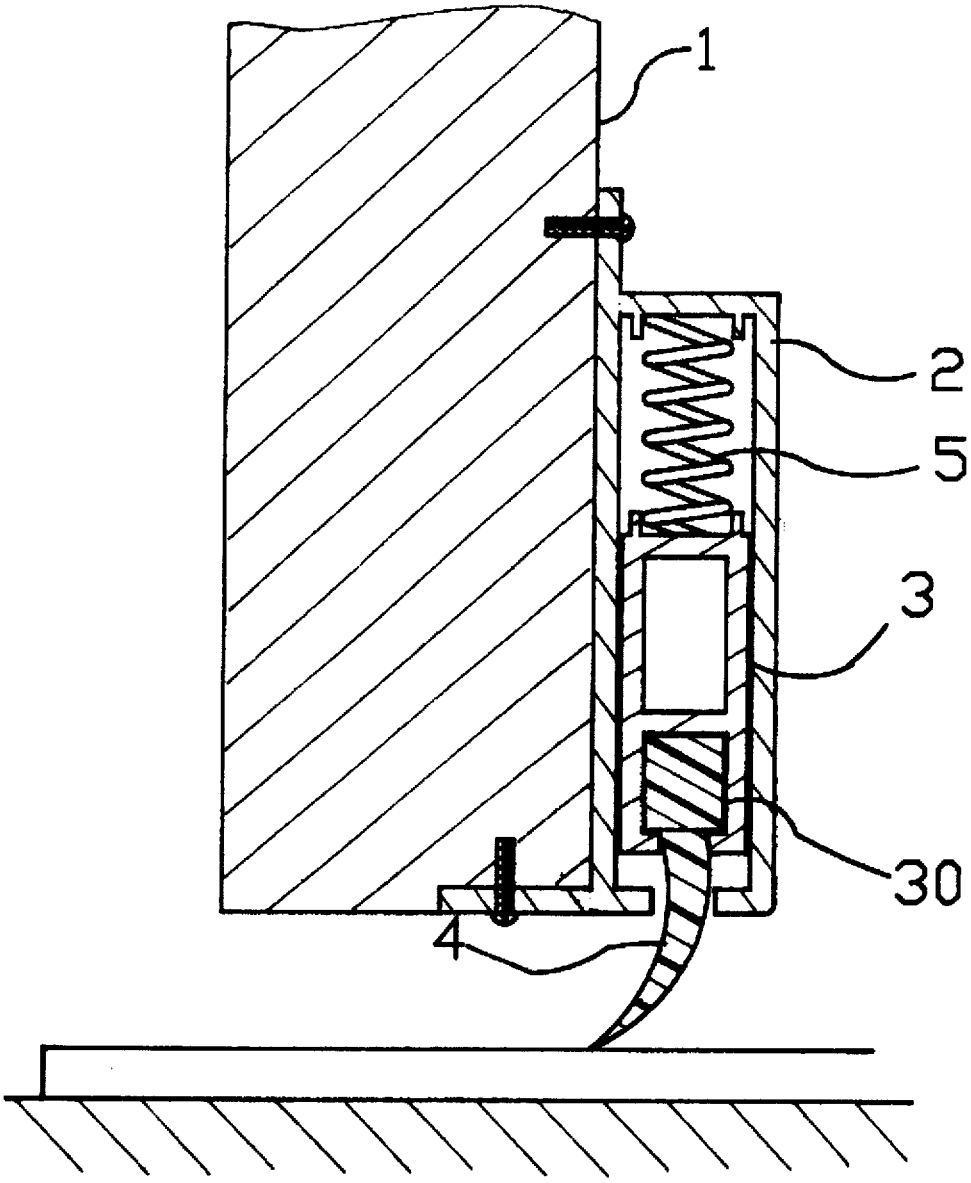
FIG. 7 is cross-sectional view of a sealing mechanism according to the third preferred embodiment of the present invention.

FIG. 7 shows the third preferred embodiment of a door-sealing mechanism according to the present invention, which can be made into a separate device and attached by screws to the side of the bottom rail of the door. The advantage of this embodiment is that the door-sealing mechanism can be independently manufactured and mounted to any types of doors. The constituent elements are all the same in function as those of the first preferred embodiment except slightly adapted in shapes according to the varied application condition.

The present invention has been described hitherto with several exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A sealing mechanism attached to a bottom of a door, which seals a horizontal gap between the bottom of the door and a sill which lies beneath the door when the door is closed, said sealing mechanism comprising:

(a) a frame adapted to be connected to the bottom of the door;

(b) a retractable mounting piece supported in the frame and having means for mounting a sealing member thereon, said retractable mounting piece being retractable into the frame when said sealing member is subject to an external force;

(c) said sealing member including a flexible, elongated blocking portion having a length greater than the height of the horizontal gap; and (d) biasing means acting upon said retractable mounting piece, for exerting a force on said sealing member in the direction of the sill when said retractable mounting piece is in its retracted position and also allowing said retractable mounting piece to restore to its original position after the external force on said sealing member is removed;

wherein said flexible blocking portion of said sealing member is bent and said retractable mounting piece is retracted when the door passes over the sill; and wherein the combined force of the bending of the flexible blocking portion and the force exerted by said biasing means together causes said flexible blocking portion to be in forced contact with the sill when the door is in its closed position.

2. A sealing mechanism as claimed in claim 1, wherein the frame is divided into two partitions so as to mount two sealing members.

3. A sealing mechanism as claimed in claim 1, wherein said blocking portion of said sealing member is triangular-shaped in cross section.

4. A sealing mechanism as claimed in claim 1, wherein said biasing means is a spring.

5. A sealing mechanism attached to a tap of a door, which seals a horizontal gap between the top of the door and a lintel which lies above the door when the door is closed, said sealing mechanism comprising:

(a) a frame adapted to be connected to the top of the door;

(b) a retractable mounting piece supported in the frame and having means for mounting a sealing member thereon, said retractable mounting piece being retractable into the frame when said sealing member is subject to an external force;

(c) said sealing member including a flexible, elongated blocking portion having a length greater than the height of the horizontal gap; and (d) biasing means acting upon said retractable mounting piece, for exerting a force on said sealing member in the direction of the lintel when said retractable mounting piece is in its retracted position and also allowing said retractable mounting piece to restore to its original position after the external force on said sealing member is removed;

wherein said flexible blocking portion of said sealing member is bent and said retractable mounting piece is retracted when the door passes over the lintel; and wherein the combined force of the bending of the flexible blocking portion and the force exerted by said biasing means together causes said flexible blocking portion to be in forced contact with the lintel when the door is in its closed position.

6. A sealing mechanism as claimed in claim 5 wherein the frame is divided into two partitions so as to mount two sealing members.

7. A sealing mechanism as claimed in claim 5, wherein said blocking portion of said sealing member is triangular-shaped in cross section.

8. A sealing mechanism as claimed in claim 5, wherein said biasing means is a spring.

* * * * *